United States Patent [19]

Brown

[11] 3,955,531

[45] May 11, 1976

[54] PRESSURE FINGER FOR DOCTOR BLADE ASSEMBLY

[75] Inventor: Jack Frederick Brown, Pierrefonds, Canada

[73] Assignee: James Ross Limited, Lachine, Canada

[22] Filed: Nov. 26, 1974

[21] Appl. No.: 527,346

[52] U.S. Cl. ..... 118/261; 15/256.51; 118/107

[51] Int. Cl.[2] ..... B05C 11/04

[58] Field of Search ..... 118/100, 101, 107, 126, 118/261; 15/256.5, 256.51; 355/15; 110/154, 167, 425; 100/174, 112; 68/270

[56] References Cited

UNITED STATES PATENTS

| | | | |
|---|---|---|---|
| 2,086,075 | 7/1937 | Gilbertson | 101/169 |
| 2,546,342 | 3/1951 | Jurgensen et al. | 118/100 |
| 2,914,788 | 12/1959 | Smith et al. | 118/126 |
| 3,163,878 | 1/1965 | Smith et al. | 15/256.51 |
| 3,377,645 | 4/1968 | Dapses | 15/256.51 |
| 3,859,690 | 1/1975 | Brown | 15/256.51 |

*Primary Examiner*—Mervin Stein
*Assistant Examiner*—Douglas Salser
*Attorney, Agent, or Firm*—Diller, Brown, Ramik & Wight

[57] ABSTRACT

A pressure finger for doctor blade assemblies is reduced in bulk and weight and deflection of a jaw of the finger which is attached to a pressure plate is avoided by the provision of at least one upstanding elongated, symmetrically arranged stiffening flange.

6 Claims, 7 Drawing Figures

PRESSURE FINGER FOR DOCTOR BLADE ASSEMBLY

BACKGROUND OF THE INVENTION i. Field of the Invention

This invention relates to doctor blade assemblies.

More particularly, it relates to fingers used in such assemblies.

ii. Description of the Prior Art

German Offenlegungschrift published May 17, 1974, in the name of Jack F. Brown describes a doctor blade assembly. The described assembly includes a doctor blade pressure plate connecting together an array of spaced-apart pressure fingers in parallel relationship. Each of the fingers has a heavy duty one-piece body having a pair of jaws defining between them a doctor blade receiving slot. One of the jaws of each finger is adapted to be permanently secured to the pressure plate.

It had been customary to machine a finger of this type from bar stock, for example, from a free-machining carbon steel. Such a machined finger is then plated to resist corrosion. Such fingers have provided an excellent heavy duty blade support for doctoring purposes.

It has been found, however, that continued exposure to an acidic or alkaline environment encountered in the doctoring operation will, in time, erode the plating and oxidation will ensue.

The fingers may be machined from bar stock of a non-corrosive material having the other physical and mechanical properties necessary, for example, stainless steel. However, the difficult machining operation makes this method of manufacture too costly to be practical.

Another way of making the finger suggested in the aforementioned publication is by casting. Since it can be readily cast in stainless steel, an excellent non-corrosive finger can be made in this way. However, attempts to modify the structure of the finger, to cut down its bulk and reduce its weight gave rise to an unexpected problem, in that the jaw attached to the pressure plate deflected more than the calculated amount.

SUMMARY OF THE INVENTION

The object of the invention is to provide a lightweight cast finger construction which overcomes the aforementioned problems and provides the necessary physical and mechanical properties for good doctoring.

The finger of the invention has a one-piece cast body including a central part provided with a transverse fulcrum for individual pivotal mounting of the finger. A tongue extends to one side of the central part for receiving doctoring pressure. A longer and a shorter jaw extend directly from the side of the central part opposite the tongue. The longer jaw has a first surface opposed to a second surface on the shorter jaw. These surfaces form between them a doctor blade-holding space extending from adjacent to the central part. The first surface is for permanent connection to the pressure plate of the doctor blade assembly.

In the improvement according to this invention, the longer jaw is relatively thin and the face of the finger, including the longer jaw and tongue, includes at least one upstanding elongated symmetrically arranged stiffening flange overlying part of the longer jaw and part of the tongue and flanking a base surface. Preferably, there are symmetrically arranged spaced-apart flanges, desirably each having a side face forming a continuation of the side free of the body.

Desirably the flange or flanges taper in height from their extremity to a convexly curved summit part overlying an intermediate part of the finger. The outside of the shorter jaw may be provided with a recess flanked by raised flanges. Desirably the surface of the outside of the finger is stepped inwards at the tongue so as to lighten the weight of this part of the finger.

According to the invention there is provided a pressure finger for a doctor blade pressure plate assembly, comprising, an integral cast body having a hub part provided with a transverse fulcrum to receive pivotal mounting means, first and second spaced-apart jaws extending from the hub part and having first and second spaced-apart inwardly facing opposed inner surfaces defining therebetween a blade-receiving slot, said first jaw being longer than said second jaw and having an outer surface opposed to said first surface, a tongue extending from the hub part in a direction opposite to that of the jaws forming a continuation of the first jaw and having a bearing surface facing the same direction as said outer surface, said bearing surface and said outer surface forming a continuous outer side extending from said first jaw to the hub part and through the tongue, said outer side including at least one continuous elongated symmetrically located flange extending outwardly therefrom to stiffen the first jaw against deflection from the second jaw.

The at least one flange should desirably terminate short of the end of the first jaw and should in any case not obstruct the flexible apron for the finger and its attachment to the finger. The at least one flange need not extend to the end of the tongue.

The present invention thus provides an improved pressure finger for a doctor pressure plate assembly, which can be made by casting a material such as stainless steel which is resistant to corrosion, at the same time avoiding unnecessary bulk. The detrimental tendency of the first jaw to deflect in use under pressures of the order of 20 pounds per linear inch to which the first jaw is subjected during use is overcome by the provision of at least one flange overlying the first jaw and tongue and extending away from the second jaw.

The finger of the invention may include a single flange located centrally of the continuous outer side extending from the first jaw to the tongue; in this case again the flange must not obstruct the flexible apron or its attachment to the finger. When a single centrally located flange is employed rather than two spaced-apart flanges, the height of the single flange projecting from the outer side of the finger is the same as for the two spaced-apart flanges, however the thickness of the sole flange is the sum of the thickness of each of the pair of flanges. The finger may also include a plurality of flanges symmetrically arranged to extend along the outer side formed by the outer surface on the first jaw and the bearing surface on the tongue.

In a particularly preferred embodiment, the pressure finger has a pair of spaced-apart flanges which curve upwardly from the first jaw to a convexly curved summit part intermediate the ends of the finger and then taper downwardly to the end of the tongue, whereby the stresses generated in the finger in use are distributed in the flanges rather than the thin sections of the first jaw and tongue. The curved summit of the flanges is preferably located at the point of maximum stress;

and the flanges are preferably of equal thickness.

The invention further provides an improved doctor blade pressure plate assembly incorporating a plurality of pressure fingers of the invention.

BRIEF DESCRIPTION OF THE DRAWINGS

The invention is illustrated with reference to the accompanying drawings showing a preferred embodiment and in which.

DESCRIPTION OF THE PREFERRED EMBODIMENTS

Figure 1:
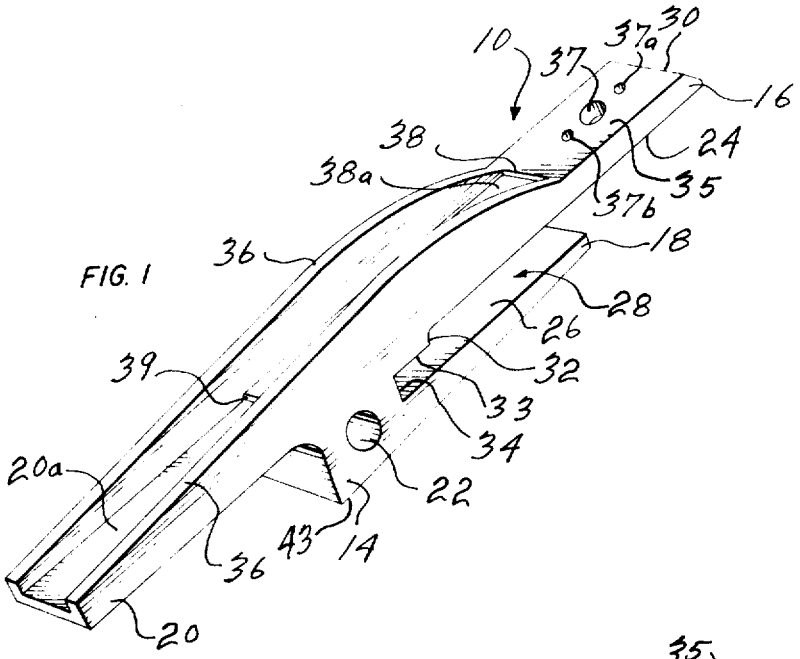
FIG. 1 is a perspective view of the preferred pressure finger.
Figure 3:
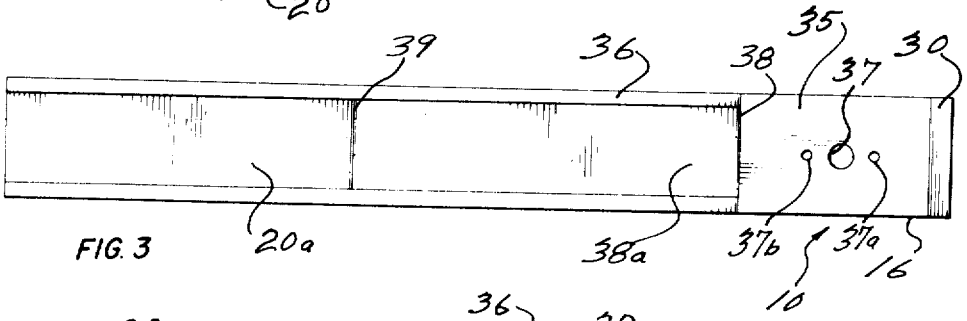
FIG. 3 is a top plan view of the finger of FIG. 1.
Figure 2:
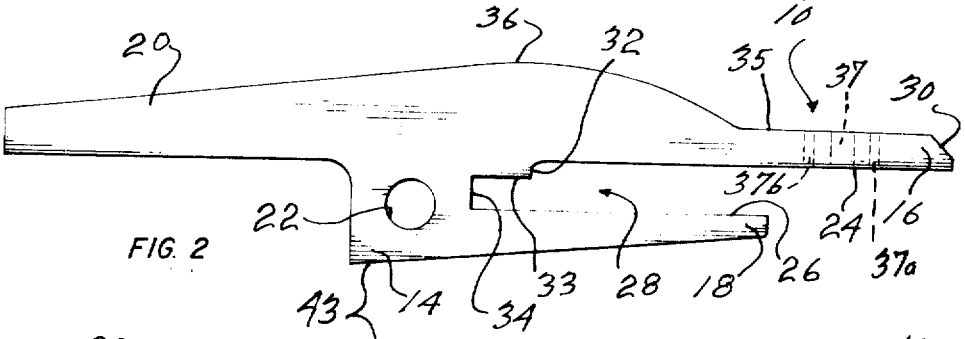
FIG. 2 is a side view of the finger of FIG. 1.

With further reference to the drawings, a pressure finger 10 comprises a rigid integral body 12 made up of a central hub part 14, first and second jaws 16 and 18 extending forwardly from the upper and lower sides of the hub part 14 and a tongue 20 integral with the first jaw 16 and extending rearwardly from the upper side of the hub part 14.

The hub part 14 has a fulcrum 22 in the form of a transversely extending cylindrical aperture.

The first jaw 16 includes an inwardly facing substantially flat first surface 24 and the second jaw 18, a flat second surface 26; the first surface 24 and second surface 26 are spaced apart in parallel facing relationship defining between the jaws 16 and 18 a slot 28.

The first jaw 16 includes a nose 30 at its outer extremity and a step 32 at its inner extremity adjacent the hub part 14 which defines a terminal surface 33. The terminal surface 33 faces the second surface 26 and defines therewith a retaining groove 34 adapted to mate with a margin of a blade seat (shown in FIG. 7) resting on the second surface 26.

The first jaw 16 includes a flat portion 35, having a tapped opening 37 and two drilled holes 37a and 37b, which terminates at a step 38 defining a portion 38a of lesser thickness which merges with a step 39 in tongue 20 defining a portion 20a of the tongue 20 of still less thickness.

A pair of spaced-apart raised flanges 36, each continuous from end to end, extend outwardly from the first jaw 16 and tongue 20 and away from the second jaw 18. In the preferred embodiment illustrated in the drawings, the flanges 36 commence adjacent step 38 and curve upwardly to a convex summit and taper downwardly to the end of the tongue 20.

Figure 4:
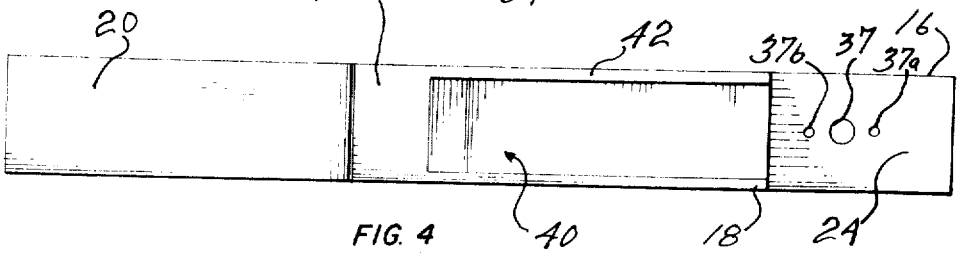
FIG. 4 is a bottom plan view of the finger of FIG. 1.

With further reference to FIG. 4, the second jaw 18 includes at its outer surface 43 a recess 40 flanked by a pair of flanges 42.

Figure 5:
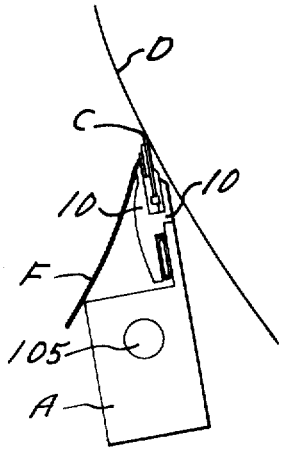
FIG. 5 is a fragmentary side elevation showing a typical relationship between a doctor blade according to the invention and a Yankee cylinder.

FIG. 5 illustrates a doctor blade mounting assembly including an array of spaced-apart pressure fingers 10, carrying a doctor blade C in doctoring position relative to the surface of a creping cylinder D (Yankee Dryer). The mounting assembly is mounted on a doctor-back A, carried from the main frame of the paper machine.

The doctor-back A is pivotally mounted as at 105 to the paper machine, at a predetermined position from the axis of the creping cylinder D, so that the member A can be rotated toward or away from the cylinder D as shown by the arrow R. This permits the doctor blade C to be set at the desired angle to the periphery of the cylinder D.

Figure 6:
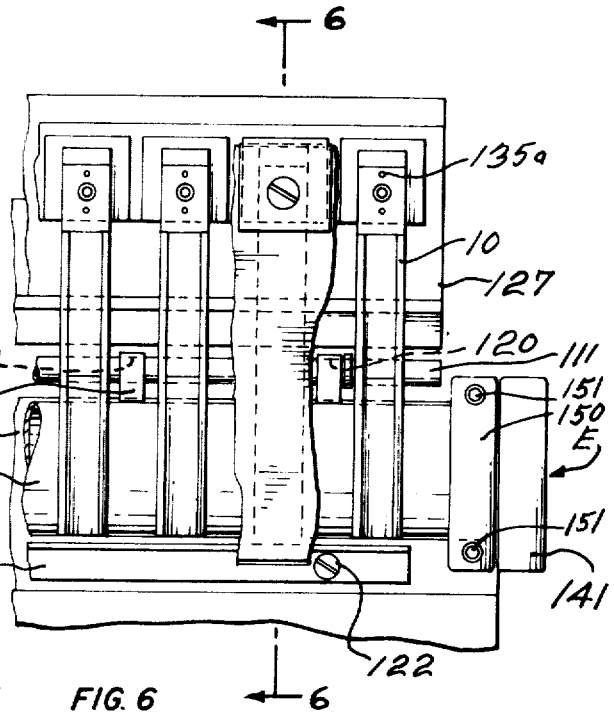
FIG. 6 is a fragmentary elevation looking in the direction of the arrow on FIG. 5, on a much larger scale, of a preferred form of doctor blade assembly.
Figure 7:
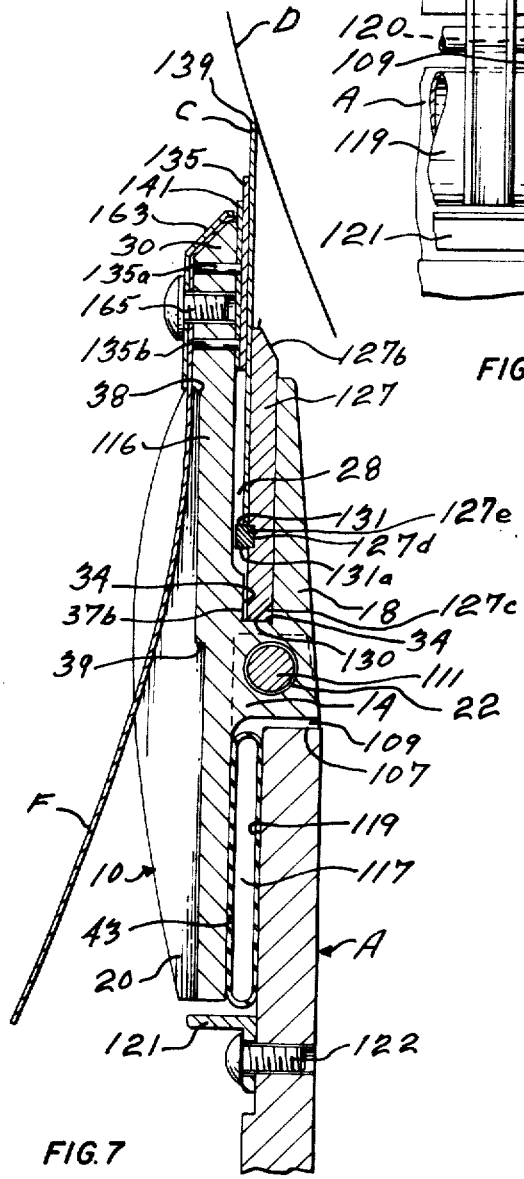
FIG. 7 is a cross-section along the line 6—6 of FIG. 6 showing the preferred pressure finger.

Referring to FIGS. 6 and 7, the mounting member A on its leading edge 107 has a plurality of support blocks 109 welded to it. Apertures 120 in the blocks 109 are aligned to receive a pivot rod 111.

Pivotally mounted between the blocks 109, and on the rod 111 are the pressure fingers 10 for carrying the blade supporting assembly and blade C. The fingers 10 are of a special shape, a preferred form of which is described with reference to FIGS. 1 to 4. As described each pressure finger 10 has a rigid body made up of a central hub part 14, an integral tongue 20 extending rearwardly from the upper side of the hub part 14, and integral jaws 16 and 18 extending forwardly from the upper and lower sides of the central hub part 14 and defining between them a slot 28. The fingers 10 are preferably of solid rigid integral construction. They can be made from a single piece of metal by machining, cast or otherwise fabricated. The slot 28 opens towards the cylinder D and is provided with opposed walls 24 and 26 (being surfaces of the jaws 16 and 18 respectively) and a rear wall 34. The slots 28 accommodate the doctor blade C and blade retaining means including a blade seat 127 and a pressure plate 135 both extending the width of the machine and one pressure pad 141 for each finger 10, details of which will be described.

The jaw 16 has the nose 30 protruding beyond the jaw 18 to a position near the surface of the cylinder D. The jaws 16 and 18 have their opposed surfaces 24 and 26, respectively, bounding the slot 28. The wall 24 is parallel to the wall 26 for most of its length and is then stepped inwards towards the wall 26 in the step 32, to produce a narrower root portion of the slot 28, constituting a retaining groove 34 receiving the trailing edge of the blade seat 127 in a loose sliding fit. This construction provides for accurate location and retention of the trailing edge of the blade seat 127 and consequently accurate positioning of its leading edge in respect to the mounting assembly and to the surface of the cylinder D.

The hub part 14 of each finger 10 is provided with a fulcrum in the form of a laterally extending cylindrical aperture 22 for receiving the rod 111. The aperture 22 is centrally located between the ends of the fingers 10. The apertures 120 in the support blocks 109 and 22 in the pressure fingers 10 are oversize relative to the pivot rod 111. This allows for play between the rod 111 and the fingers 10 and support blocks 109. This, in turn, permits rocking movement between the pressure fingers and the rod, as well as pivotal movement.

The tongue 20 has its surface 43 overlying a portion of the mounting member A but spaced from it to provide a space 117 for a continuous inflatable tube 119. The tube 119 is held in place by a retainer 121 mounted on the mounting member A and held to it by screws 122. In the form shown, the retainer 121 is an angle iron, but can take other forms. When the tube 119 is inflated, the fingers 10 pivot about the rod 111 clockwise urging the doctor blade C, carried in the slots 28, against the cylinder D under the pressure of the plate 135.

More specific reference will now be made to the blade seating, which can be seen specially in FIGS. 6 and 7. Mounted on each pressure finger 10 is a main pressure plate 135 which extends across the width of the cylinder D. The plate 135 is attached by means to be described to the walls 24 of the fingers 10. The plate 135 assists in distributing force evenly across the width of the creping edge 139 of the doctor blade C. When the tube 119 is inflated, pressure is substantially uniformly applied to the creping edge 139 of the blade C through the fingers 10. The assembly thus has substantial flexibility in the axial direction of the cylinder D and substantial rigidity in the tangential direction.

Preferably, pressure pads 141 are attached individually to each finger 10 to intervene the wall 24 and the plate 135 so as to provide further rigidity of the plate 135 in the tangential direction without impairing its flexibility in the axial direction of the cylinder D. Each pad 141 stops short of the front edge of its plate 135 so that the plate 135 has a part projecting beyond it, as shown. This provides a springing effect in the plate 135.

Held in the slots 28 is a doctor blade seat 127 which is substantially the length of the doctor blade C and extends through all the fingers 10 the entire width of the machine. The blade seat 127 is a continuous plate which has its opposed longitudinal margins chamfered to provide sloping faces 127*b* and 127*c* terminating in edges 128 and 130 to provide greater radial clearance between the member 127 and the cylinder D. The seat 127 is provided on the opposing face to the chamfers with a longitudinal groove 127*d* parallel to and spaced from the edges 128 and 130. Mounted in the slot 127*d* is a blade abutment made up of a plurality of elongated metal segments 127*e* of rectangular cross-section spaced apart to provide for thermal expansion. The segments 127*e* are held in place in the groove 127*d* to the seat 127 by suitable means, for example, self-threading screws (not shown). The segments 127*e* protrude from the surface of the seat 127 so that their edges 131 or 131*a* provide the abutment for the rear edge of the doctor blade C.

The blade seat 127 is preferably made of a thermally stable sheet material so that it remains unaffected by elevated operating temperatures. One material which has specially good qualities is sheet made of an asbestos matte filler impregnated with a thermosetting (preferably phenolic) resin binder and known on the market under the trade mark "ROBCO GRADE 101" sold by Joseph Robb Limited, Montreal, Canada.

In practice, a number of such blade seats 127 are supplied to the customer with each doctor. This is so that the customer can use doctor blades of different widths. A new doctor blade is usually about four inches wide. By repeated use, the blade can wear down to 2-⅝th inches in width. In practice, when a blade has worn down by about 1/16th of an inch it is reground so as to give it a new square edge. To maintain the same contact point of the blade with the cylinder it must be advanced relative to the mounting assembly. This is necessary to ensure that the correct angular relationship between the cylinder D and the doctor blade C is maintained.

Customers are, therefore, supplied with several blade seats for each doctor having their seating edges 131 at different distances from the edges 128 and 130. Normally, the blade seat 127 has a width of about 3 inches and the seating member 127*e* can have its seating edge 131 spaced anywhere from about ¾ of an inch to about 2 inches from the leading edge 128 of the blade seat 127. The blade seat 127 can also be inverted so that instead of the edge 128 being the leading edge (nearest the cylinder D) the edge 130 becomes the leading edge.

The pressure fingers 10 are normally disposed with the slots 28 facing upwardly during operation. The blade seat 127 is thus retained in the slots 28 through its own weight bearing against the back walls 34 and the doctor blade C is urged by gravity and the pressure of the Yankee cylinder D so that it abuts against shoulder 131.

A new blade seat 127, slid into the slots 28 in the axial direction of the cylinder D cleans each slot automatically by pushing out any debris which may have accumulated in it during the previous creping operations. The ejected material falls through the spaces between the sides of the pressure fingers 10. A similar cleaning action also occurs when a new doctor blade is slid in an axial direction of the cylinder D along the blade abutment 127e.

To provide a guide for the creped sheet and to prevent access of waste material to the moving parts of the assembly, the following means is provided. A flexible apron F, for example, of neoprene or other suitable flexible material, is attached to the ends of the pressure fingers 10 and is draped over the assembly as shown running the entire width of the apparatus. The attachment is accomplished by a clip 163 on each pressure finger 10 which fits over the nose of each upper jaw 16 and is locked to it by a screw 165 entering tapped opening 37 in flat portion 35 of the end of the jaw 16. The free margin of the sheet F is held between the undersurface of the clip 163 and the upper surface of the pressure jaw 16. The clips 163 are preferably of stainless steel sheet.

The pressure tube 119 is pliable, but impermeable and non-expansible and is substantially the length of the doctorback A. It can be of a neoprene-lined polyester jacketted non-expandable tube. Alternatively, it may be of a woven "terylene" reinforced silicon rubber tube which is used for high temperatures. "Terylene" is a trade mark for a polyester material.

An adapter E is shown in FIG. 6 for retaining the assembly of the tube 119 to the doctorback A and for introducing air is as follows. The adapter E is illustrated in FIGS. 6 and 7 of the aforementioned Offenlegungschrift, the disclosure of which is hereby incorporated by reference and is made up of a main block 41, an integral spigot 42 of the cross-section shown so as to provide it with an underface 47 which lies on the doctorback A, a parallel face 44 and sloping side faces 45 and 46. The cross-sectional shape of the spigot is adapted for receiving the end of the tube 119, the combined length of the surfaces 43, 44, 45 and 46 being equal to the inside periphery of the tube 19 which fits tightly about the spigot 42. Encircling the spigot 42 are a pair of spaced apart grooves 47 and 48 in the faces 43, 44, 45 and 46. The grooves produce a positive seal, when the neoprene lining of the pressure tube 119 is forced into them under the pressure of retaining means to be described. The adapter E is provided with air connections 49 leading from the outer face of the block 41 to the inner face of the spigot 42. To retain the end of the tube 119 in position on the spigot 42 a top tube clamp 50 is applied over the tube 119 and is bolted through bolts 51 to the doctorback A.

An adapter E of the type described may be applied at each end of the doctor blade assembly to secure each end of the tube 119 and to supply air to it. Alternatively, only one adapter E may be employed at one end of the tube, with a simple clamp arrangement to seal the tube and secure it to the doctorback A at the other end of the tube 119.

The support blocks 109 and the rod 111 are preferably made of stainless steel to guard against corrosion and possible seizure of the parts. The fingers 10 are either made of stainless steel or if of another metal are plated with a non-corrosive metal. The pressure plate 135 and the pressure pads 141 are preferably made from spring stainless steel, having the necessary springiness. The rivets 135*a* which attach the pressure plate 135 and the pressure pads 141 to the upper jaws 16 of the fingers 10 are desirably of stainless steel.

There are features of the apparatus which have not been described in detail but whose function and operation will be readily understood. For example, the pressure tube 119 is operated in the usual manner for doctor assemblies from a source of pressure not shown so as to exert even pressure on the fingers 10. The pressure tube 119 can conveniently have a bore of 1.75 inches.

The doctor blade C is a heavy duty type with an elongated steel sheet usually having a thickness within the range of about 32 to about 50 thousandths of an inch. Typical pressure plates will have a thickness within the range of from about 50 to about 60 thousandths of an inch. Typical pressure pads will have approximately the same thickness as the pressure plates. The pivot rod 111 is usually of the order of 0.5 inches in diameter but this can vary.

A typical pressure finger 10 for a 5 inch doctorblade C has the following dimensions.

| | |
|---|---|
| Overall length | 9 inches |
| Overall width | 1 inch |
| Length of jaw 16 from extremity to centre of fulcrum 22 | 5.562 ± 0.020 inches |
| Length of jaw 18 from extremity to centre of fulcrum 22 | 4 inches |
| Length of tongue 20 from extremity to centre of fulcrum 22 | 3 7/16 inches |
| Diameter of fulcrum 22 | 7/16 inches + 0.000 inch − 0.010 inch |
| Thickness of tongue 20 | 3/16 inches |
| Thickness of jaw 16 at flat portion 35 | 5/16 inches |
| Thickness of jaw 16 in central portion | 7/32 inches |
| Thickness of flanges 36 | 3/16 inches |
| Diameter of tapped opening 37 | 5/16 inches |
| Space between jaws 16 and 18 defining slot 28 | 0.425 inches |
| Radius of curvature of flanges 36 on a centre located at a vertical distance 2 inches from the centre of fulcrum 22 (on the side containing jaw 18 and 1 inch horizontal distance from the centre of fulcrum 22 in the direction of jaw 18) | 3.25 inches |
| Distance eof drilled holes 37a and 37b | 1/8 inches |

A typical pressure finger 10 for a 4 inch doctor blade C has the same dimensions as above except that the length of the jaws 16 and 18 are reduced by 1 inch thus

| | |
|---|---|
| Overall length | 8 inches |
| Length of jaw 16 from extremity to centre of fulcrum 22 | 4.562 ± 0.020 inches |
| Length of jaw 18 from extremity to centre of fulcrum 22 | 3 inches |

The construction of a doctor for creping is heavier than that of a cleaning doctor. This heavy construction is required because of the high linear pressure on the creping doctor blade. The present doctor blade assembly is designed for creping doctor blades, but it could be applied to other purposes, one example of which is the removal of food products in powder form from drying cylinders.

I claim:

1. A pressure finger for a doctor blade pressure plate assembly, comprising, an integral cast body having a hub part provided with a transverse fulcrum to receive pivotal mounting means, first and second spaced apart jaws extending from the hub part and having first and second spaced apart inwardly facing opposed inner surfaces defining therebetween a blade-receiving slot, said first jaw being longer than said second jaw and having an outer surface opposed to said first surface, a tongue extending from the hub part in a direction opposite to that of the jaws forming a continuation of the first jaw and having a bearing surface facing the same direction as said outer surface, said bearing surface and said outer surface forming a continuous outer side extending from said first jaw to the hub part and through the tongue, said outer side including at least one continuous elongated symmetrically located flange extending outwardly therefrom to stiffen the first jaw against deflection from the second jaw.

2. A pressure finger as defined in claim 1, in which there are a pair of spaced apart flanges protruding from said outer side from an intermediate position on said first jaw to an outer position of said tongue, said flanges increasing in height from their ends to an intermediate summit part.

3. A pressure finger, according to claim 2 wherein the portion of said first jaw bounded by said flanges is of lesser thickness than the remainder of said first jaw.

4. A pressure finger according to claim 3 wherein said tongue is of lesser thickness than said portion of said first jaw.

5. A pressure finger according to claim 1, wherein said second jaw has a recess defined in its outer surface opposite to said second surface.

6. A pressure finger according to claim 2, wherein said summit part occurs at a point of maximum stress.

* * * * *